US011405732B2

(12) United States Patent
Honda et al.

(10) Patent No.: US 11,405,732 B2
(45) Date of Patent: Aug. 2, 2022

(54) HEARING ASSISTANCE DEVICE

(71) Applicants: Cear, Inc., Tokyo (JP); freecle Inc., Tokyo (JP)

(72) Inventors: Yasushi Honda, Tokyo (JP); Yoshitaka Murayama, Tokyo (JP); Sosuke Kubo, Tokyo (JP); Taichi Sekiguchi, Tokyo (JP)

(73) Assignees: CEAR, INC., Tokyo (JP); FREECLE INC., Tokyo (JP)

( * ) Notice: Subject to any disclaimer, the term of this patent is extended or adjusted under 35 U.S.C. 154(b) by 0 days.

(21) Appl. No.: 17/282,464

(22) PCT Filed: Sep. 30, 2019

(86) PCT No.: PCT/JP2019/038604
§ 371 (c)(1),
(2) Date: Apr. 2, 2021

(87) PCT Pub. No.: WO2020/071331
PCT Pub. Date: Apr. 9, 2020

(65) Prior Publication Data

US 2021/0385587 A1 Dec. 9, 2021

(30) Foreign Application Priority Data

Oct. 4, 2018 (JP) ..... JP2018-189580

(51) Int. Cl.
*H04R 25/00* (2006.01)
*G10L 21/0224* (2013.01)
*H04R 25/02* (2006.01)

(52) U.S. Cl.
CPC ..... *H04R 25/40* (2013.01); *G10L 21/0224* (2013.01); *H04R 25/02* (2013.01); *H04R 25/453* (2013.01)

(58) Field of Classification Search
CPC ..... H04R 1/1083; H04R 2225/025; H04R 25/60; H04R 25/603; H04R 2460/01;
(Continued)

(56) References Cited

U.S. PATENT DOCUMENTS

2017/0193978 A1* 7/2017 Goldman ..... H04R 1/1041
2017/0272867 A1* 9/2017 Zisapel ..... G02C 11/06
(Continued)

FOREIGN PATENT DOCUMENTS

CN 103646587 A 3/2014
JP H01-093298 A 4/1989
(Continued)

OTHER PUBLICATIONS

Chinese Office Action dated Mar. 16, 2022 corresponding to application No. 201980078382.0.

*Primary Examiner* — George C Monikang
(74) *Attorney, Agent, or Firm* — Nath, Goldberg & Meyer; Jerald L. Meyer

(57) ABSTRACT

A hearing assistance device which is worn by the user and which can suppress the voices produced by the user wearing the hearing assistance device is provided. When the user wears the hearing assistance device 1, a pair of microphones is separated and positioned on both sides of a head of the user and a pair of speakers is separated and positioned on both ears of the user or positioned near the ears and which emits sound. The hearing assistance device includes a noise canceller 96 which subtracts a signal processed by a mouth directivity sound processor 93 from the input signal from at least one of the microphones L and R, in which the mouth directivity sound processor 93 emphasizes voice produced from a sound source positioned at a mouth of the user.

9 Claims, 15 Drawing Sheets

(58) Field of Classification Search
CPC ..... G10L 25/78; G10L 21/0208; G10L 2021/065; H04S 1/005
USPC ..... 381/312, 314, 317
See application file for complete search history.

(56) References Cited

U.S. PATENT DOCUMENTS

| | | | | |
|---|---|---|---|---|
| 2018/0366146 | A1* | 12/2018 | Spriet | G10L 25/21 |
| 2019/0167123 | A1* | 6/2019 | Hidaka | A61B 5/0261 |

FOREIGN PATENT DOCUMENTS

| | | | |
|---|---|---|---|
| JP | 04-90298 | A | 3/1992 |
| JP | 2011-97268 | A | 5/2011 |
| JP | 2013-81042 | A | 5/2013 |
| JP | 2014059544 | A | 4/2014 |
| JP | 2014147023 | A | 8/2014 |
| JP | 2016039632 | A | 3/2016 |
| WO | 2016063462 | A1 | 4/2016 |

* cited by examiner

HEARING ASSISTANCE DEVICE

FIELD OF INVENTION

The present disclosure relates to a hearing assistance device which is worn by users and which collects ambient sound by microphones and emits collected sound by speakers.

BACKGROUND

Hearing ability of individuals is limited depending on themselves, and it is hard for peoples to hear ambient sound beyond their hearing ability. Achieving a hearing ability beyond what people originally have without using equipment is difficult, however, if it is possible like in phantasy, humanity may further progress. For example, hearing aids have potential in that they can achieve hearing ability beyond what people originally have.

Generally, hearing aids include microphones and speakers, in which microphones collect ambient sound and speakers emit sound collected by the microphones. Since hearing aids amplify the collected sound to a level which can be clearly heard by users and emit the amplified sound, the users wear hearing aids to simply listen to ambient sound more clearly.

Furthermore, there are hearing aids that belong to medical equipment to assist hard of hearing who has lost their hearing ability due to, for example, aging and disease, and this medical equipment has same function as the hearing aids in that they amplify the collected sound to a level which can be clearly heard by users and emit the amplified sound.

PRIOR ART DOCUMENT

Patent Document

Patent Document 1: Japanese Laid-Open Patent JP2014-147023

SUMMARY OF INVENTION

Problems to be Solved by Invention

Hearing assistance devices such as above hearing aids and medical equipment uniformly raises levels of the collected sound and emit the collected sound. Therefore, when a user wearing the hearing assistance device talk with someone else, the hearing assistance device collects user's voice as well, and if the hearing assistance device emit the collected sound from a speaker, the user will hear their own voice from the speaker. Furthermore, when the user and the other person talk at the same time, it will be difficult for the user to listen to the other person's voice because of their own voice. Therefore, the hearing assistance device that can suppress voices produced by the user wearing the hearing assistance device is desired.

The present disclosure is achieved to address the above technical problems, and the objective thereof is to provide the hearing assistance device which is worn by the user and which can suppress the voices produced by the user wearing the hearing assistance device.

Means to Solve the Problem

To achieve the above objective, a hearing assistance device according to the present disclosure is a hearing assistance device worn by a user, including:

a pair of speakers which is positioned on both ears of the user or positioned near the ears and which emits sound;

a pair of microphones which is positioned on both sides of a head of the user;

a mouth sound processor which relatively emphasizes voice produced from a sound source positioned at a mouth of the user based on an input signal from each of the microphones; and a noise canceller which subtracts a signal processed by the mouth sound processor from the input signal from the microphones.

The hearing assistance device further includes a voice detector which detects a voice produced by the user based on the input signal from each of the microphones, and the noise canceller subtracts the signal processed by the mouth sound processor from the input signal from the microphones when the voice is produced by the user.

The hearing assistance device further includes a gazing direction sound processor which relatively emphasizes a voice from a sound source in a gazing direction of the user, and the noise canceller may subtract the signal processed by the mouth sound processor from the signal processed by the gazing direction sound processor.

The microphone inputting the signal to the gazing direction sound processor includes two omnidirectional microphones, and the two omnidirectional microphones may be arranged on a line in parallel with the gazing direction of the user.

The hearing assistance device may include a switching controller to output the signal from the noise canceller to the speaker based on a switching signal.

The hearing assistance device may include a blur detector which detects a blur of the two microphones arranged near one of the speakers, and the hearing assistance device may include a switching signal outputter which outputs the switching signal when the blur detector detects the blur for a certain time or more.

The hearing assistance device may include a switch which receives an input from the user, and the hearing assistance device may include a switching signal outputter which outputs the switching signal by ON/OFF of the switch.

In addition, an aspect of the present disclosure may include a glasses-type and a necklace type hearing assistance device.

Effect of Invention

According to the present disclosure, the hearing assistance device emits a suppressed voice produced by the user who is wearing the hearing assistance device from the microphones, the user can listen to other person's voice and ambient sound more clearly.

EMBODIMENTS

In below, embodiments of a hearing assistance device according to the present disclosure will be described with the reference to figures.

1. First Embodiment (Structure)

Figure 1:
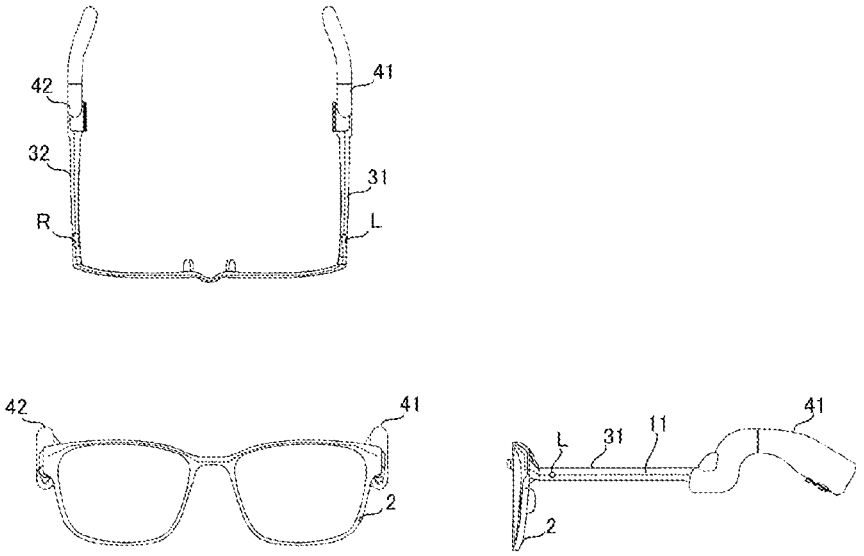
FIG. 1 is an external view of a hearing assistance device according to a first embodiment.
Figure 2:
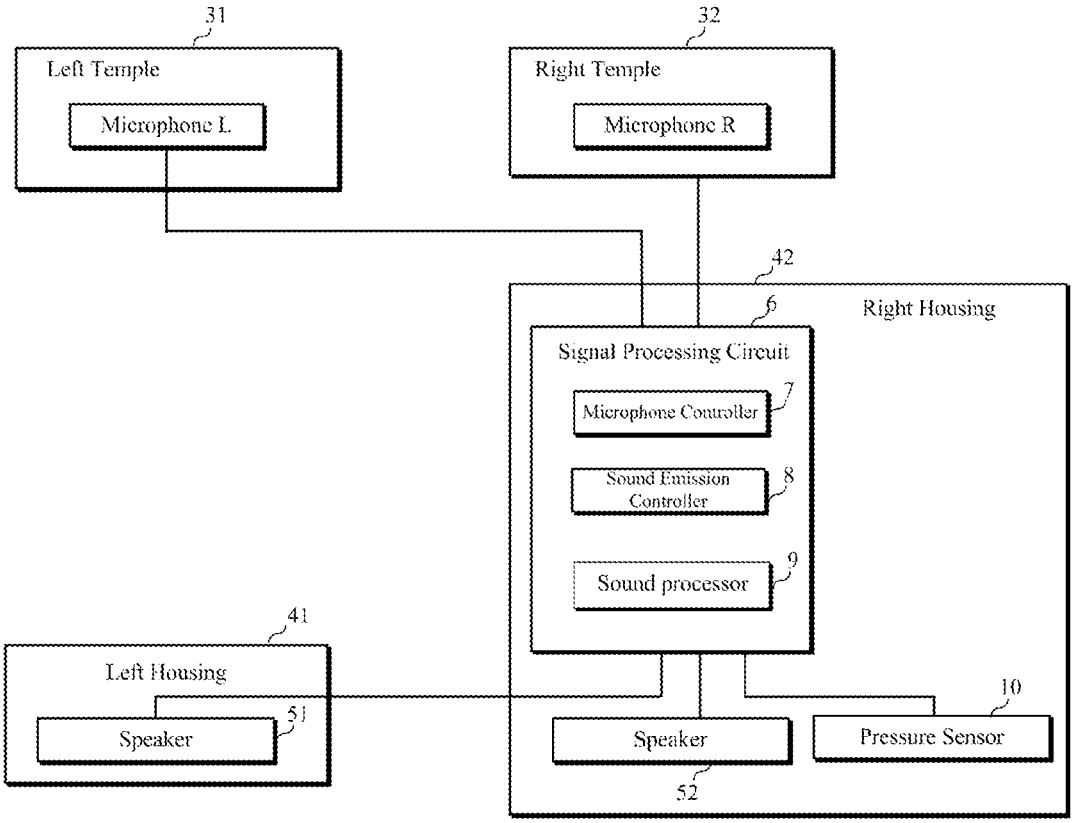
FIG. 2 is a block diagram illustrating internal structures of the hearing assistance device according to the first embodiment.

FIG. 1 is an external view of a hearing assistance device. Furthermore, FIG. 2 is a block diagram illustrating internal structures of the hearing assistance device. As illustrated in FIGS. 1 and 2, a hearing assistance device 1 is worn by a user, collects sound around the user, and emits collected sound to the user.

The hearing assistance device 1 is a glasses-type. That is, the hearing assistance device 1 includes a rim 2 to fix lenses, right and left temples 31 and 32 supporting the rim 2, earpieces which are portions in contact with ears of the user and which are positioned at tips of the right and left temples 31 and 32. The hearing assistance device 1 includes a pair of microphones L and R arranged at the right and left temples 31 and 32, and the right and left earpieces includes housings 41 and 42 having speakers therein.

The omnidirectional microphones L and R are arranged inside the right and left temples 31 and 32. Each microphones L and R are at both sides of a head of the user, respectively, and are arranged symmetrically relative to a mouth of the user.

The hearing assistance device 1 is formed by connecting the microphones L and R, and the pair of right and left housings 41 and 42 by a code 11 including a signal line therein. Speakers 51 and 52 are contained in the housings 41 and 42. The user wears the hearing assistance device 1 such that the housings 41 and 42 correspond with respective ears of the user.

As illustrated in FIG. 2, a signal processing circuit 6, etc., are contained inside the housing 42, in addition to the speaker 52. A pressure sensor 10 that works as a switch operated by the user is arranged inside the code 11. The microphones L and R, the speakers 51 and 52, and the pressure sensor 10 are connected to the signal processing circuit 6 via the signal line. The speaker 51 contained in the housing 41 which does not have the signal processing circuit 6, and the microphones L and R arranged inside the respective temples are connected to the signal processing circuit 6 via the code 11 connecting the housings 41 and 42.

The pressure sensor 10 is a switch for turning on the microphones L and R and for switching the functions thereof. The user presses the pressure sensor 10 via a cover of the code 11 to uses the pressure sensor 10. The pressure sensor 10 senses the pressing force and outputs an operation signal to the signal processing circuit 6 in response to sensing the pressing force.

The signal processing circuit is a so-called processor and includes microcomputers, ASIC, FPGA, or DSP, etc. The signal processing circuit 6 includes a microphone controller 7, a sound emission controller 8, and a sound processor 9.

The microphone controller 7 is a driver circuit for the microphones L and R. The microphone controller 7 is connected to the pressure sensor 1*o* via the signal line. The microphone controller switches ON and OFF of power supply to the microphones L and R each time the operation signal is input from the pressure sensor 10. The sound emission controller 8 transmits the signal converted in the sound processor 9 to the speakers 51 and 52.

The sound processor 9 is arranged between the microphones L and R and the speakers 51 and 52, and processes the input signal from the pair of microphones L and R and transmits the processes signal to the speakers 51 and 52. In the sound processing performed by the sound processor 9, a signal InA(k) in which voice from a sound source located at a mouth of the user is emphasized is subtracted from input signals InM1(*k*) and InM2(*k*) of the microphones L and R. The voice from a sound source located at the mouth of the user is practically a voice produced by the user. The sound processor 9 includes a filter C1 to match phases of the input signals InM1(*k*) and InM2(*k*), and the signal InA(k), and the sound processor 9 matches the phase of the input signals InM1(*k*) and InM2(*k*) and the phase of the signal InA(k), and acquires a difference therebetween.

The sound processor 9 may subtract the signal InA(k) from each of the input signals InM1(*k*) and InM2(*k*) or may subtract the signal InA(k) from one of the input signals InM1(*k*) and InM2(*k*). In a case of subtracting the signal InA(k) from each of the input signal InM1(*k*) and InM2(*k*), the sound emission controller 8 outputs a signal obtained by subtracting the signal InA(k) from the input signal InM2(*k*) to the speaker 51 and outputs a signal obtained by subtracting the signal InA(k) from the input signal InM1(*k*) to the speaker 52. Meanwhile, in a case of subtracting the signal InA(k) from one of the input signals InM1(*k*) and InM2(*k*), for example, the sound emission controller 8 outputs a signal obtained by subtracting the signal InA(k) from the input signal InM1(*k*) that is a signal to be subtracted to the speakers 51 and 52. In below, the case in which the sound emission controller 8 outputs the signal obtained by subtracting the signal InA(k) from the input signal InM1(*k*) to the speakers 51 and 52 is described.

Figure 3:
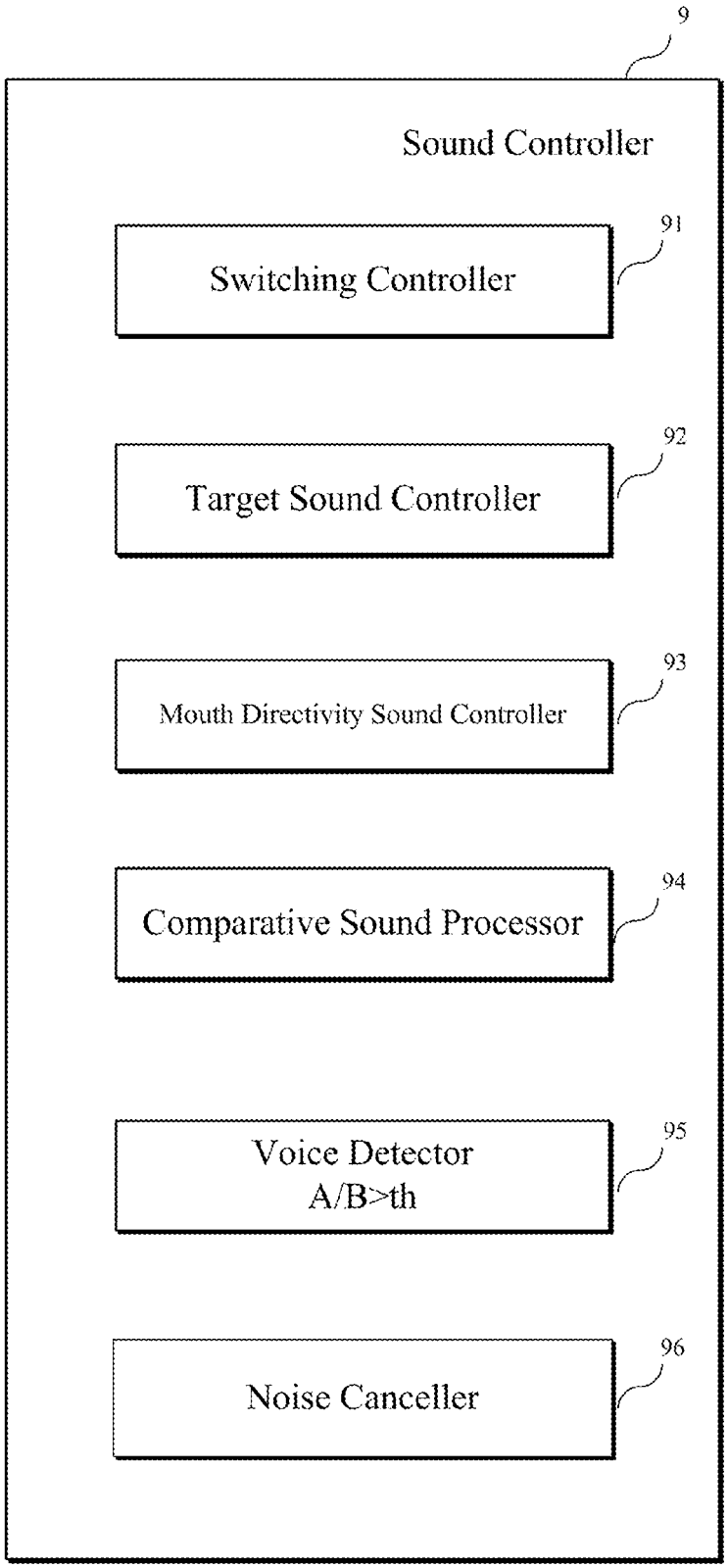
FIG. 3 is a block diagram illustrating internal structures of a sound processor according to the first embodiment.
Figure 4:
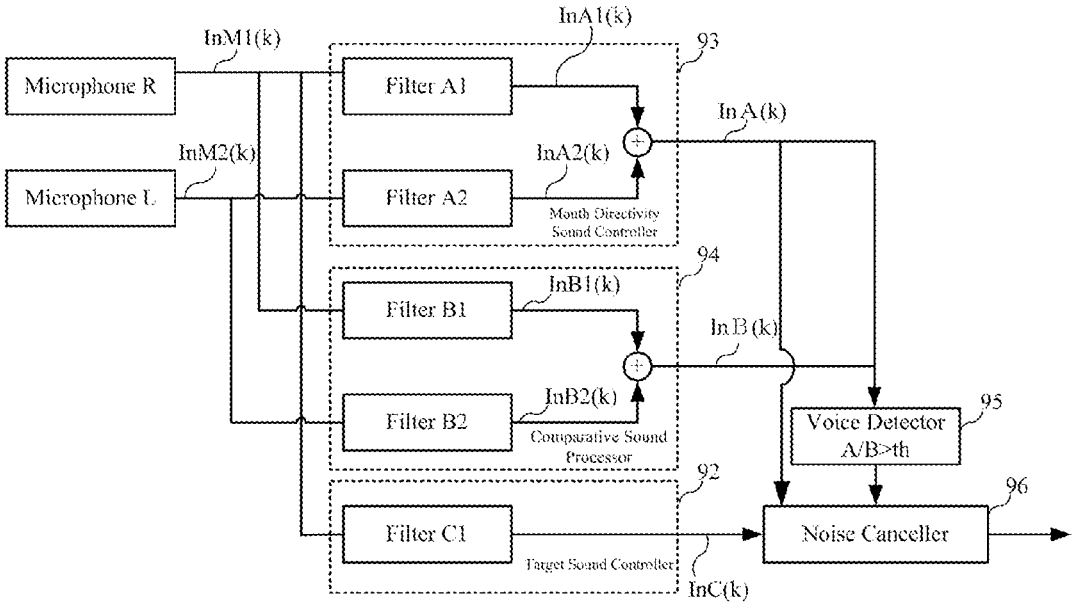
FIG. 4 is a functional block diagram illustrating structures of the sound processor according to the first embodiment.

FIG. 3 is a block diagram illustrating internal structures of the sound processor 9, and FIG. 4 is a functional block diagram illustrating structures of the sound processor 9. As illustrated in FIG. 3, the sound processor includes a switching controller 91, a target sound processor 92, a mouth directivity sound processor 93, a comparative sound processor 94, a voice detector 95, and a noise canceller 96.

The switching controller 91 switches whether to subtract the signal InA(k) from the input signal InM1(*k*) in the sound processor 9 or not in accordance with the input from the pressure sensor 10. That is, when the switching controller 91 is ON, the signal InA(k) is subtracted from the input signal InM1(*k*) in the sound processor 9, while when the switching controller 91 is OFF, the signal InA(k) is not subtracted from the input signal InM1(*k*) in the sound processor 9 and the sound emission controller 8 outputs the input signal of the microphones L and R to which level adjustment was performed as necessary to the speakers 51 and 52.

The target sound processor 92 produces a signal InC(k) that is a target from which the signal InA(k) would be subtracted, in which the signal InA(k) is a voice from the sound source located at the mouth of the user relatively emphasized based on the input signal InM1(*k*). The signal InC(k) that is the target is produced by matching the phase of the input signal InM1(*k*) and the phase of the signal InA(k). Therefore, the target sound processor 92 includes a filter C1. The filter C1 is an all-pass filter designed according to a least-squares method or Wiener method such that square error of amplitudes between the input signal InM1(*k*) and the signal InA(k) would be minimum.

That is, although the signal InA(k) is produced by the input signal InM1(*k*) and the signal InA(k), the phase of the signal InA(k) shifts relative to the phase of the input signal InM1(*k*) at the time production. Therefore, voice of the user cannot be effectively suppressed by simply subtracting the signal InA(k) which is the relatively emphasized voice from the sound source located at the mouth of the user from the input signal InM1(*k*). Accordingly, the target sound processor 92 makes the input signal InM1(*k*) pass through the filter C to produce the signal InC(k). By passing through the filter C1, the phase of the produced signal InC(k) matches with the phase of the signal InA(k).

The mouth directivity sound processor 93 produces the signal InA(k) which the relatively emphasized voice from the sound source located at the mouth of the user. The mouth directivity sound processor 93 can be referred to as a first sound processor. That is, the mouth directivity sound processor 93 relatively emphasizes a sound signal which was produced from the sound source located on an axis of symmetry of the pair of microphones L and R. The mouth directivity sound processor 93 relatively emphasizes the sound signals that have same phase difference or the time difference, and the more there is the phase difference or the time difference, relatively suppresses the sound signal. Therefore, the mouth directivity sound processor 93 includes a filter A1 and a filter A2.

Figure 5:
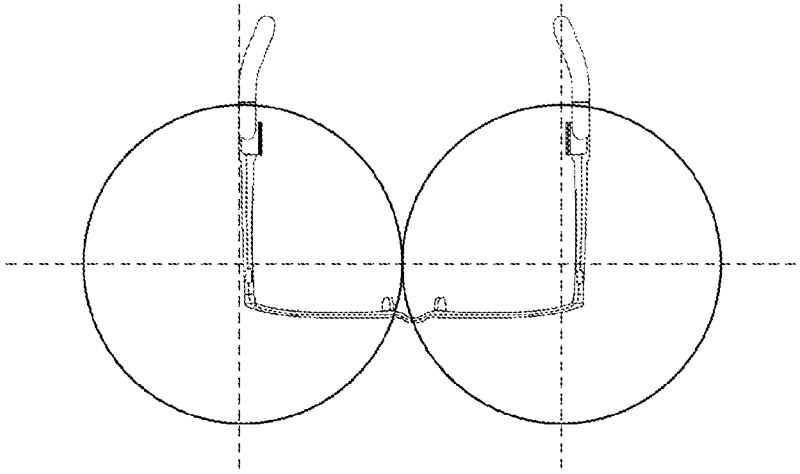
FIG. 5 is a graph indicating a polar pattern of a signal processed by a mouth directivity sound processor.

The filter A1 and the filter A2 are filters to adjust the phases of the input signals InM1(*k*) and InM2(*k*) such that an amplitude of the signal InA(k) that is the signal obtained by adding a signal InA1(*k*) which is the input signal InM1(*k*) which has passed through the filter A1 and a signal InA2(*k*) which is the input signal InM2(*k*) which has passed through the filter A2 would be maximum. A parameter coefficient H1 of the filter A1 and a parameter coefficient H2 of the filter A2 are values uniquely defined by a transfer function from the mouth to the microphones L and R. The signal InA(k) produced by the mouth directivity sound processor 93 has a polar pattern illustrated in FIG. 5.

The comparative sound processor 94 produces a signal InB(k) which is a relatively emphasized sound from a sound source other than the sound source located at the mouth of the user. The comparative sound processor 94 relatively emphasizes a sound signal which was produced from the sound source other than the sound source located on the axis of symmetry of the pair of microphones L and R. Therefore, the comparative sound processor 94 includes a filter B1 and a filter B2.

Figure 6:
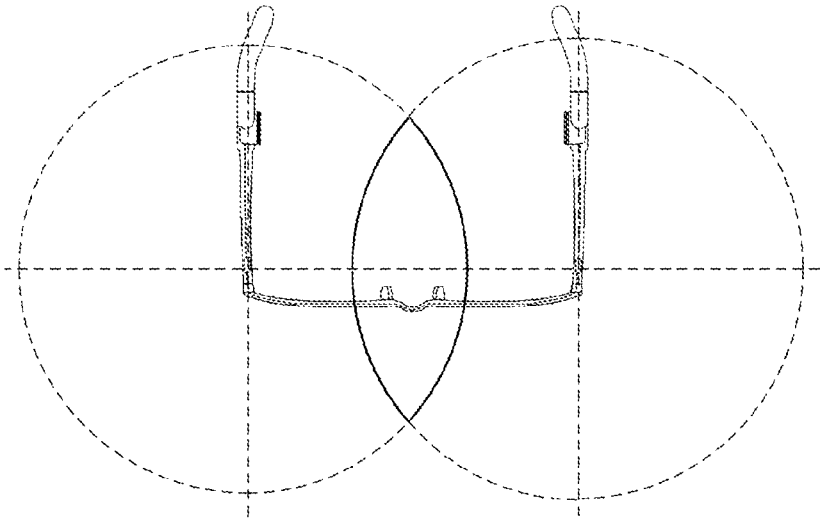
FIG. 6 is a graph indicating a polar pattern of a signal processed by a comparative sound processor.

The filter B1 and the filter B2 are filters to adjust the phases of the input signals InM1(*k*) and InM2(*k*) such that an amplitude of the signal InB(k) that is the signal obtained by adding a signal InB1(*k*) which is the input signal InM1(*k*) which has passed through the filter B1 and a signal InB2(*k*) which is the input signal InM2(*k*) which has passed through the filter B2 would be minimum. A parameter coefficient H3 of the filter B1 and a parameter coefficient H4 of the filter B2 are values uniquely defined by the transfer function from the mouth to the microphones L and R. The signal InB(k) produced by the comparative sound processor 94 has a polar pattern illustrated in FIG. 6.

The voice detector 95 detects the voice produced by the user based on the signal InA(k) processed in the mouth directivity sound processor 93, the signal InB(k) processed in the comparative sound processor 94 and a predetermined threshold. The voice detector 95 compares a ratio of the signal InA(k) from the mouth directivity sound processor 93 and the signal InB(k) from the comparative sound processor 94 with a threshold th. By this, the voice produced by the user can be detected. When the user did not produce voice, there would be no large difference in intensities between the signal InA(k) and the signal InB(k). In contrast, when the user has produced the voice, the intensity of the signal InA(k) that is the relatively emphasized voice from the sound source located at the mouth of the user. Therefore, the difference in the intensities is more emphasized by signal InA(k)/InB(k). The emphasized intensity is compared with the threshold th that is a threshold related to intensity, and when the intensity is more than the threshold th, it is determined that the user has produced the voice.

Figure 7:
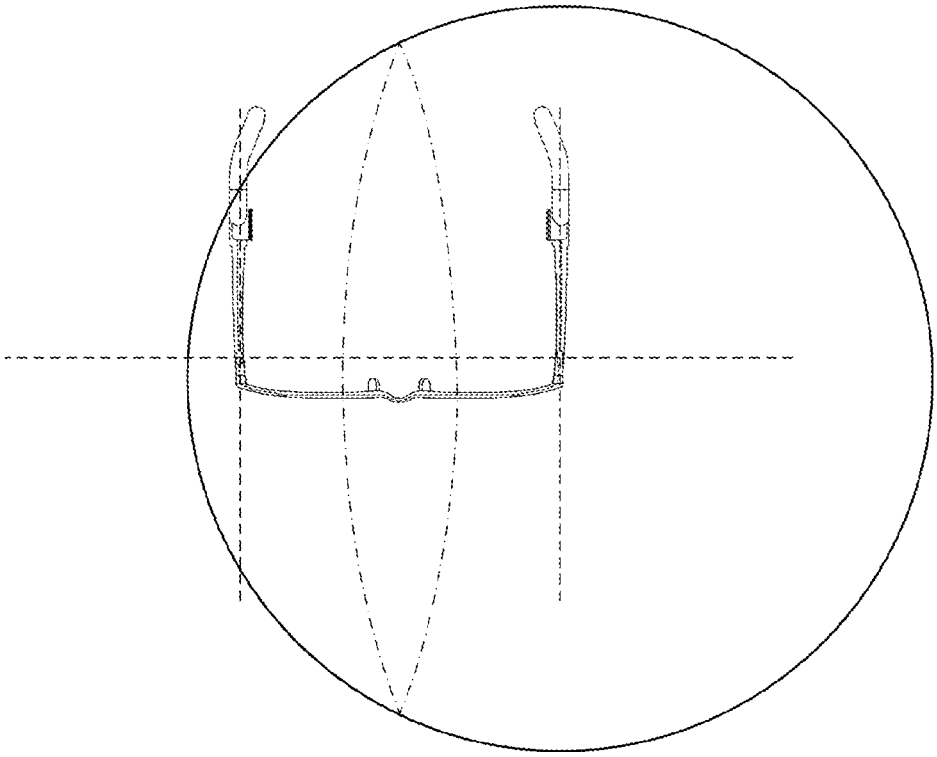
FIG. 7 is a graph indicating a polar pattern of a signal processed by a noise canceller.

When the voice detector 95 determines that the user has produced the voice, the noise canceller 96 subtracts the signal InB(k) that is the relatively emphasized sound from the sound source other than the sound source located at the mouth of the user from the signal InC(k) processed by the target sound processor 92. As method to subtract the signal InA(k) from the signal InC(k), a spectral subtraction method, a MMSE-STSA method, and a Wiener-filtering method may be used. The signal from the noise canceller 96 has characteristics which is a solid line from which a dotted line is subtracted in a polar pattern illustrated in FIG. 7.

(Action)

In the present embodiment having the above structures, the user must wear the hearing assistance device 1 on the head when requiring support of the device. Since the hearing assistance device 1 is a glasses-type, the user always wears the hearing assistance device 1 having prescription lenses when the user needs to correct their sight. Also, the user may wear the hearing assistance device 1 when necessary when the user does not need to correct their sight. Even in this case, since the hearing assistance device 1 is the glasses-type, the user can wear without the others recognizing that the user is wearing the hearing assistance device 1.

When the user wears the hearing assistance device 1, the microphones L and R arranged in the right and left temples 31 and 32 are separately positioned on both sides of the head of the user symmetrically relative to the mouth of the user that is the center axis. Furthermore, the speakers 51 and 52 are arranged near the ears of the user.

Figure 8:
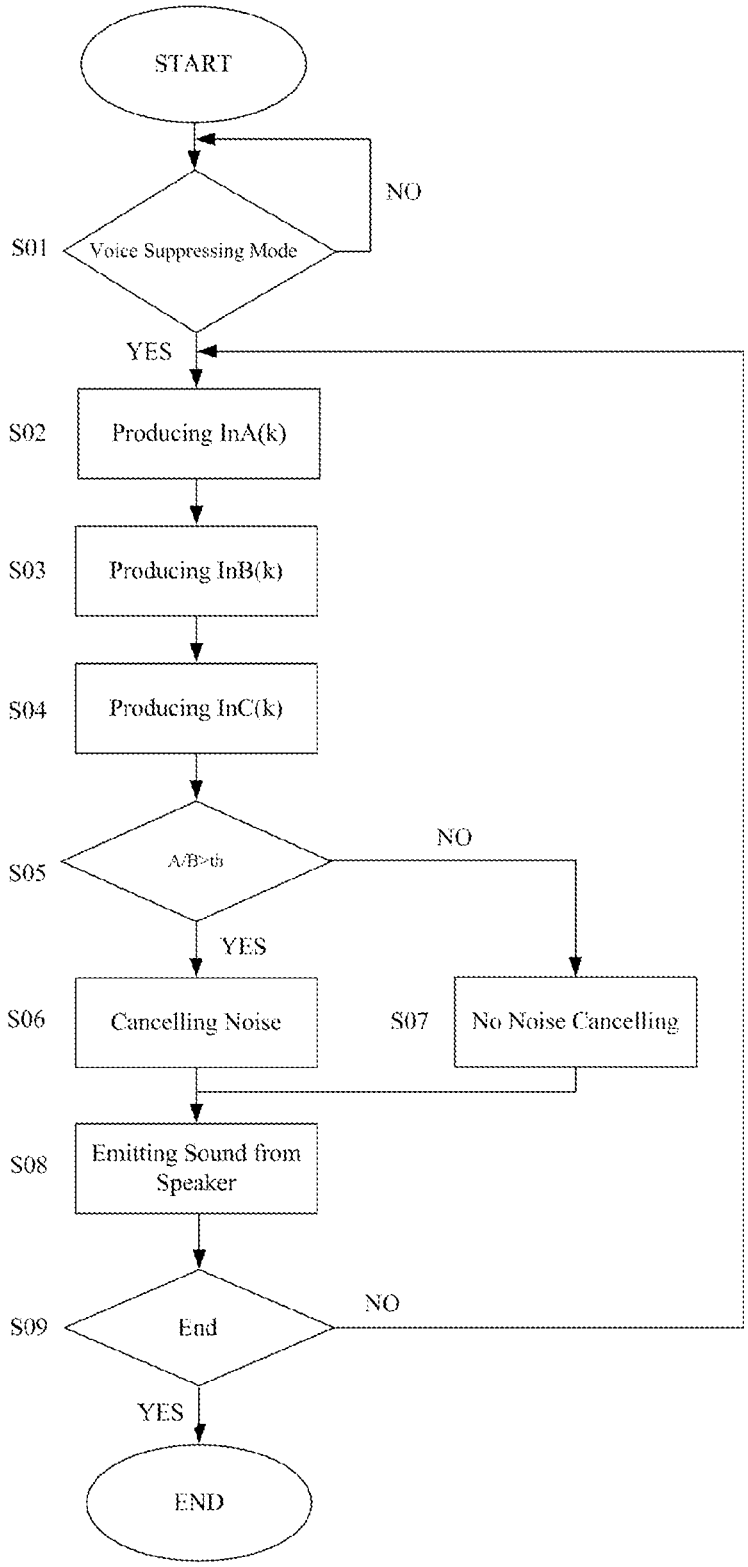
FIG. 8 is a flowchart indicating a sound processing procedure according to the first embodiment.

In a state the power supply of the hearing assistance device 1 is ON, that is, a state the microphone controller 7 starts or is maintaining the power supply to the microphones L and R, the user operates the pressure sensor 10 to switch a normal mode and a voice suppressing mode. The normal mode is a mode that emits the signal from the microphones L and R which the level thereof was adjusted from the speakers 51 and 52, and is a mode that does not perform processing to suppress the voice of the user to the input signal from the microphones L and R. On the other hand, the voice suppressing mode is a mode that performs processing to suppress the voice of the user to the input signal from the microphones L and R. In below, operations of the hearing assistance device 1 is described with the reference to FIG. 8.

When the voice suppressing mode is selected, an input destination of the input signal InM1(*k*) and the input signal InM2(*k*) from the microphones L and R are switched to the sound processor 9 (SO1).

The mouth directivity sound processor 93 to which the input signal InM1 (*k*) and the input signal InM2 (*k*) were input produces the signal InA(k) that is the relatively emphasized voice from the sound source located at the mouth of the user based on the input signal InM1(*k*) and the input signal InM2(*k*) (SO2).

Furthermore, the comparative sound processor to which the input signal InM1(*k*) and the input signal InM2(*k*) were input produces the signal InB(k) that is the relatively emphasized sound from the sound source other than the sound source located at the mouth of the user based on the input signal InM1(*k*) and the input signal InM2 (*k*) (SO3).

The target sound processor 92 to which the signal InM1(*k*) is input produces the signal InC(k) based on the signal InM1(*k*) (SO4.)

Accordingly, the voice detector 95 detects the voice of the user based on the signal InA(k) processed in the mouth directivity sound processor 93, the signal InB(k) processed in the comparative sound processor 94, and the predetermined threshold (S05). When the voice detector 95 detects the voice of the user (YES in S05), the noise canceller 96 transmits the signal InC(k) from which the signal InA(k) was subtracted to the speakers 51 and 52 (S06). On the other hand, when the voice detector 95 does not detect the voice of the user (NO in S05), the noise canceller 96 does not subtract the signal InC(k) from the signal InA(k) and transmits only the signal InC(k) to the speakers 51 and 52 (S07). Then, the speakers emit the sound based on the signal InC(k) or the signal InC(k) from which the signal InA(k) was subtracted (S08). This is repeated until the voice suppressing mode is stopped or until the power supply of the hearing assistance device 1 becomes OFF (S09).

Figure 9:
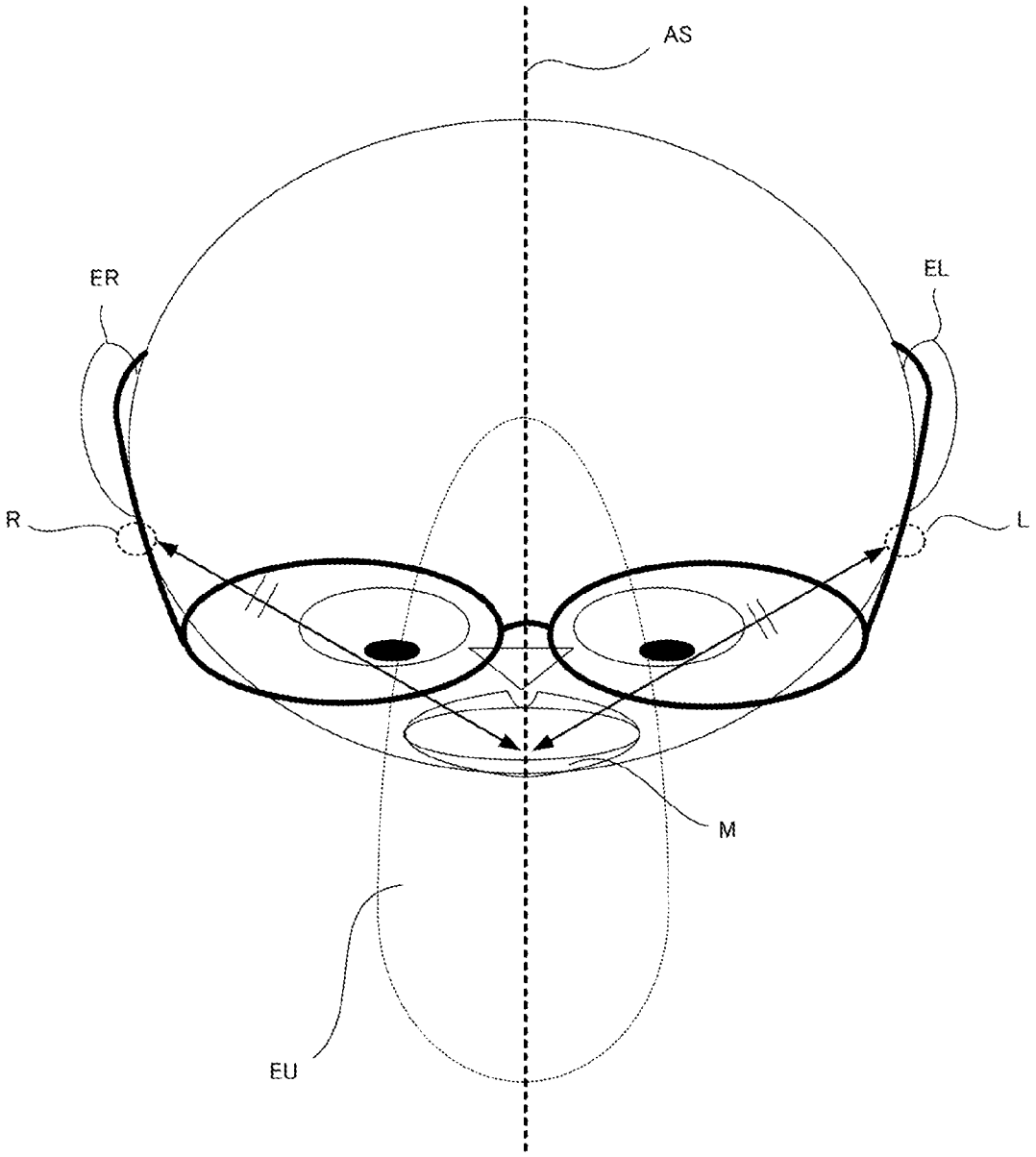
FIG. 9 is a schematic diagram illustrating a usage aspect of the hearing assistance device according to the first embodiment.

Here, FIG. 9 is a schematic diagram illustrating a usage aspect of the hearing assistance device 1. When the user wears the hearing assistance device 1, the microphones L and R contained in the right and left temples 31 and 32 are separately positioned on both sides of the head of the user. Since the positions where the microphones L and R are arranged are at equal distance from the rim, the microphones L and R are arranged at positions symmetrical relative to the mouth M of the user that is the center axis. That is, the mouth M is a sound source present on an axis of symmetry of the microphones L and R.

The mouth directivity sound processor 93 relatively emphasizes the sound signals that have same phase difference or the time difference, and the more there is the phase difference or the time difference, relatively suppresses the sound signal. The sound signals produced from the sound source on the axis AS of symmetry has same phases or arrives at the same time. Therefore, a unidirectional region EU including the mouth M is formed in the mouth directivity sound processor 93, and in the signal InA(k) from the mouth directivity sound processor 93, the voice of the user is relatively emphasized, and noise around is relatively suppressed.

On the other hand, the input signal InM1(*k*) input to the target sound processor 92 is a signal collected by the omnidirectional microphone L, and the signal InC(k) calculated by the target sound processor 92 does not have directivity to specific directions. That is, the signal InC(k) is a signal that is a sound uniformly collected sound around the user. Subtracting the signal InA(k) from the signal InC(k) by the noise canceller when the user produces voice may be referred to as subtracting the voice produced by the user from the uniformly collected sound around the user.

(Effect)

(1) As described above, when the user wears the hearing assistance device 1 according to the present disclosure, the pair of microphones L and R are positioned at both sides of the head of the user, and the pair of speakers are positioned at or positioned near the ears of the user. As one example, there is the glasses-type hearing assistance device 1 including the microphones L and R arranged in the temples 31 and 32 and the speakers 51 and 52 are contained in the housing integrated with the earpiece. In addition, the hearing assistance device 1 includes the mouth directivity sound processor 93 which relatively emphasizes the voice from the sound source positioned at the mouth of the user, and the noise canceller which subtracts the signal processed by the mouth directivity sound processor 93 based on the input signal from at least one of the microphones L and R.

The mouth directivity sound processor 93 processes the voice produced from the mouth of the user located on the axis of symmetry between the microphone L and R to relatively emphasize the voice and produces the signal InA(k). Meanwhile, the target sound processor 92 matches the phase of the input signal of the microphones L and R with the signal InA(k) to produce the signal InC(k). By subtracting the signal InA(k) from the signal InC(k), the voice produced by the user can be subtracted from the uniformly collected signal around the user.

(2) Furthermore, the voice detector 95 which detects the voice of the user based on the input signal of microphones L and R. When the user talks, the user does not continuously produces voice and the timings when the user produces voice is limited. If filtering is performed to subtract the relatively emphasized voice from the sound source positioned at the mouth of the user from the uniformly collected signal around the user even when the user is not producing voice, the voice emitted from the speakers would be unnatural. Therefore, it is desirable that the timings to perform filtering is when the user produces voice. Since the voice detector 95 the production of the voice of the user based on the input signals InM1(*k*) and InM2(*k*) from the microphones L and R, the voice produced by the user can be subtracted from the uniformly collected signal around the user only when the user is producing voice without any additional features.

(3) In addition, the hearing assistance device includes the switching controller 91 which switches whether to perform filtering of the voice produced by the user or not based on the switching signal from the pressure sensor 10. The user may feel odd when subtracting the voice produced by the user from the uniformly collected sound around the user depending on the surrounding environment and individuals. In this case, ON/OFF of the filtering may be selected by the switching controller 91.

(4) Moreover, the switching controller 91 may switch whether to perform filtering of the voice produced by the user or not based on not only the signal from the pressure sensor but also a blur detection sensor which detects blurs of the hearing assistance 1. For example, the microphones L and R may be used as the blur detection sensor. By monitoring a diagram of the microphones L and R, the hearing assistance device 1 detects blurs. When the hearing assistance device 1 is not blurring, it can be determined that the sight of the user is constant and is fixed to the person talking with, that is, the user is talking with to someone. When the user is talking, a possibility for the user to speak is high, so that necessity to subtract the voice produced by the user from the ambient sound is high. On the other hand, when the hearing assistance device 1 is blurring, it can be determined that the user is not talking, so that the hearing assistance device 1 can stop subtracting the voice produced by the user from the ambient sound.

2. Second Embodiment (Configuration)

Figure 10:
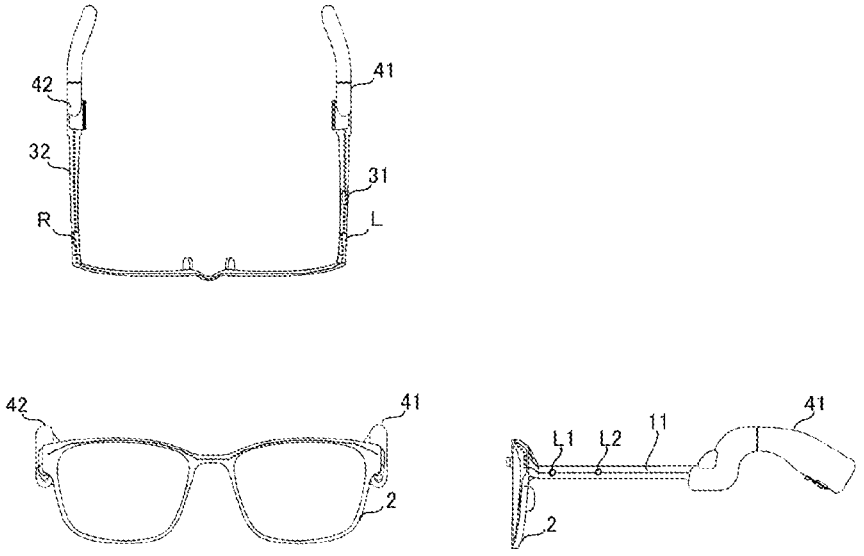
FIG. 10 is an external view of a hearing assistance device according to a second embodiment.

The second embodiment will be described with the reference to figures. Although the microphone in the first embodiment L is single omnidirectional microphone, a microphone L in the second embodiment is two omnidirectional microphones. FIG. 10 is an external view of a hearing assistance device 1 according to the second embodiment, and FIG. 11 is a block diagram illustrating internal structures of the hearing assistance device 1 according to the second embodiment.

Figure 11:
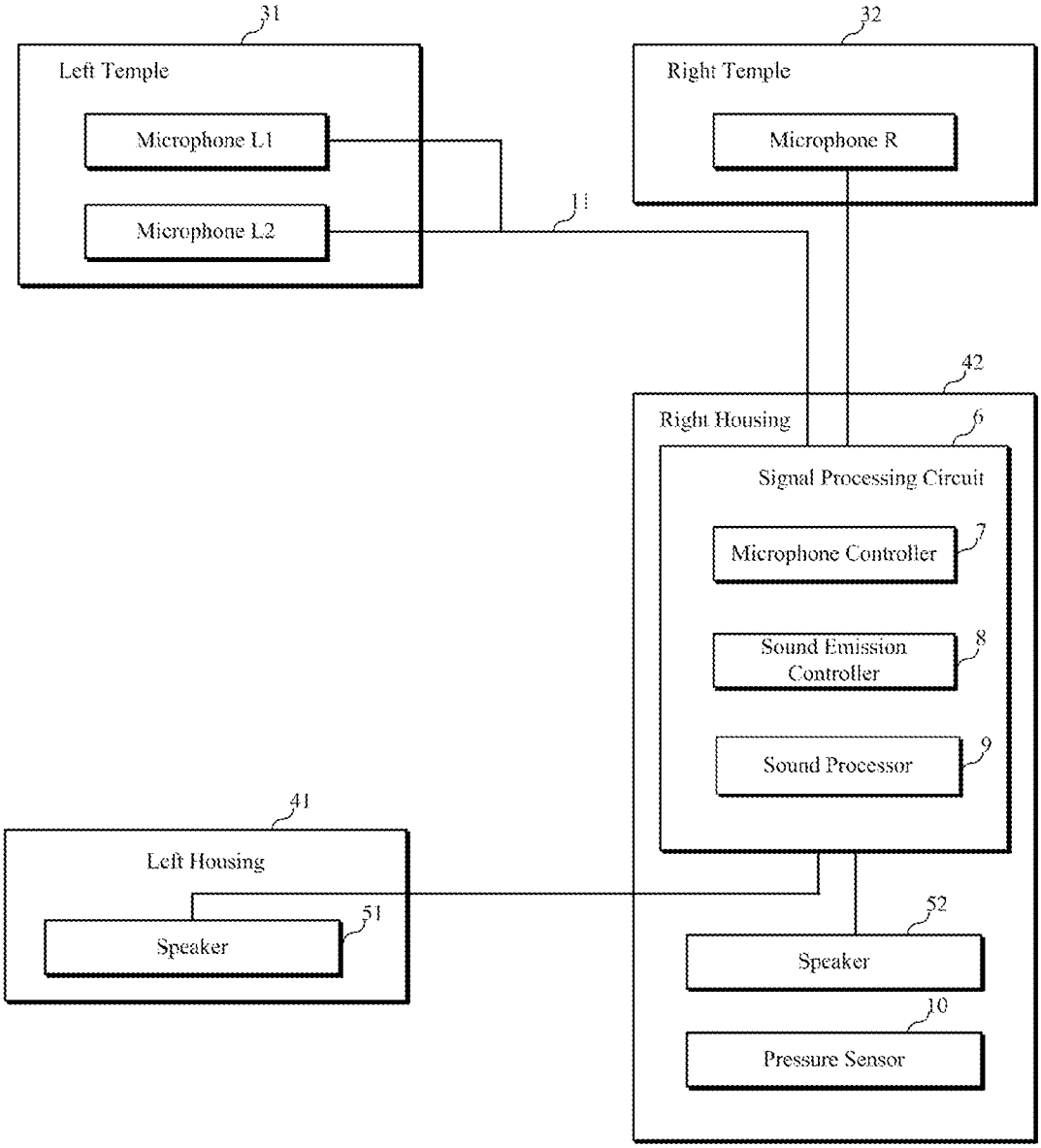
FIG. 11 is a block diagram illustrating internal structures of a hearing assistance device according to the second embodiment.

As illustrated in FIGS. 10 and 11, two omnidirectional microphones L1 and L2 is arranged in the left temple 31. The microphone L1 is arranged at a position proximal to the rim, and the microphone L2 is arranged at a position distal to the rim, that is, at the housing 42-side. When the user wears the hearing assistance device 1, the microphones L1 and L2 arranged on a line in parallel with the gazing direction of the user when viewed the user from right above or from the side. By producing directivity frontward using the microphones L1 and L2, the directivity matches the gazing direction of the user even when the head of the user moves up, down, right, and left.

Figure 12:
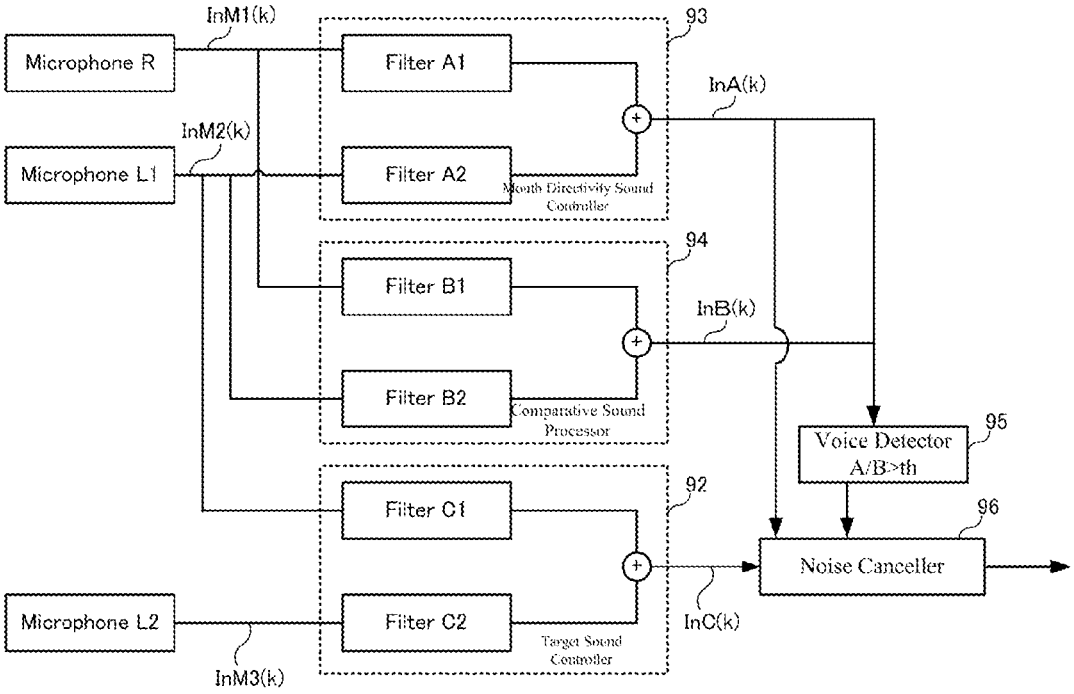
FIG. 12 is a functional block diagram illustrating structures of the sound processor according to the second embodiment.

FIG. 12 is a functional block diagram illustrating structures of the sound processor. As illustrated in FIG. 12, the sound processor 9 processes the signal from the microphones L1, L2, and R, and transmits the processed signal to the speakers 51 and 52. In the sound processing performed by the sound processor 9, the sound processor 9 produces the signal InC(k) which directivity in the gazing direction of the user is emphasized based on signal collected by the microphones L1 and L2 and the signal InA(k) which the voice from the sound source located at the mouth of the user is emphasized based on the signal collected by the microphones L1 and R, and subtracts the signal InA(k) from the signal InC(k).

The target sound processor 92 produces the signal InC(k) which the directivity in the gazing direction of the user is emphasized based on the input signal InM2(*k*) from the microphone L1 and the input signal InM2(*k*) from the microphone L2. Furthermore, the target sound processor 92 matches the phase of the signal InC(k) and the phase of the signal InA(k). The target sound processor 92 can be referred to as a second sound processor. The target sound processor 92 includes the filter C1 and a filter C2.

Figure 13:
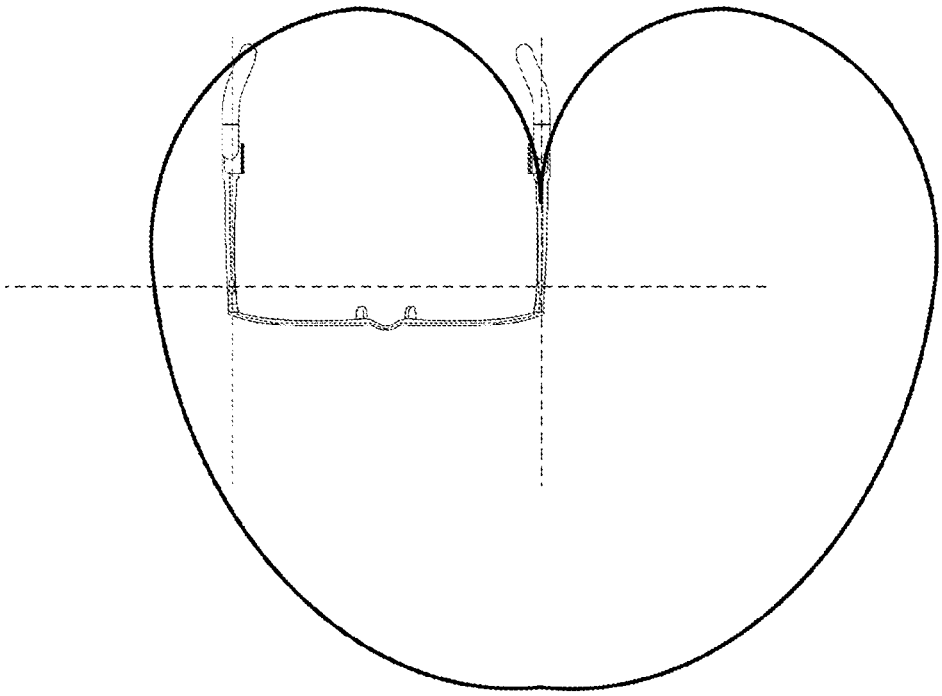
FIG. 13 is a graph indicating a polar pattern of a signal processed by a target sound processor.

The filter C1 and the filter C2 are filters to adjust the phases of the input signals InM2(*k*) and InM3(*k*) such that a directivity of the signal InC(k) that is the signal obtained by adding a signal InC1(*k*) which is the input signal InM2(*k*) which has passed through the filter C1 and a signal InC2(*k*) which is the input signal InM2(*k*) which has passed through the filter C2 would be in the gazing direction of the user. The filters C1 and C2 have a phase adjustment function designed such that square error of amplitudes between the input signal InC(k) and the signal InA(k) would be minimum to match the phase of the signal InC(k) and the phase of the signal InA(k). A parameter coefficient H5 of the filter C1 and a parameter coefficient H6 of the filter C2 are values uniquely defined by a transfer function from the person taking with the user in the gazing direction of the user to the microphones L1 and L2. The signal InC(k) produced by the target sound processor 92 has a polar pattern illustrated in FIG. 13.

Figure 14:
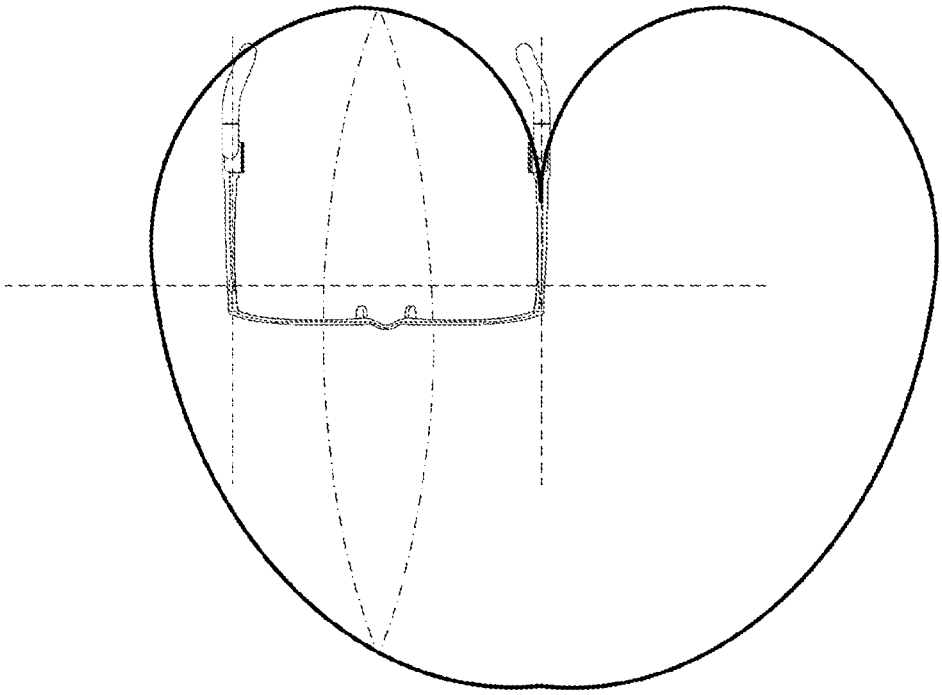
FIG. 14 is a graph indicating a polar pattern of a signal processed by a noise canceller.

When the voice detector 95 determines that the user has produced the voice, the noise canceller 96 subtracts the signal InA(k) that is the relatively emphasized sound from the sound source other than the sound source located at the mouth of the user from the signal InC(k) processed by the target sound processor 92. The signal in which the signal InA(k) is subtracted from the signal InC(k) has characteristics which is a solid line from which a dotted line is subtracted in a polar pattern illustrated in FIG. 14.

In the present embodiment having the above configuration, when the user wears the hearing assistance device 1 on the head and the power supply of the hearing assistance device 1 is ON, the hearing assistance device 1 suppresses the voice of the user by processing the signal having directivity frontward produced by the microphones L1 and L2 when the voice suppressing mode is selected.

(1) In the hearing support device 1 according to the present embodiment, the microphone L in pair with the microphone R includes two omnidirectional microphones L1 and L2. The signal InC(k) in which the voice from the sound source in the gazing direction of the user is produced using the microphones L1 and L2. The noise canceller performs processing to subtract the signal InB(k) which is the relatively emphasized sound from the sound source other than the sound source located at the mouth of the user from the signal InC(k) which is the relatively emphasized voice from the sound source in the gazing direction of the user. By this, the voice produced by the user can be subtracted from the emphasized signal in front of the user. When the user talks, the gazing direction of the user would mainly be directed toward the person talking with. The voice produced by the user can be subtracted from the signal in which the voice of the person talking with is emphasized when the user directs the directivity frontward.

(2) In the present embodiment, the microphone L in pair with the microphone R is two omnidirectional microphones L1 and L2. The voice in the gazing direction of the user is emphasized by only using the two omnidirectional microphones. Generally, microphones having directivity tend to become large. Therefore, it is difficult to arrange said microphones inside the temple. Since the voice in the gazing direction of the user can be emphasized by only using the two omnidirectional microphones, the voice in the gazing direction of the user can be emphasized by only using microphones that can be arranged inside the temple having size limit. Accordingly, even when the hearing assistance device is a glasses-type, designs of the temples are not restricted. Meanwhile, such limitations are not considered, the microphone L may be one unidirectional microphone instead of two omnidirectional microphones L1 and L2. By this, The voice produced by the user can be subtracted from the signal in which the voice of the person talking with is emphasized when the user directs the directivity frontward.

3. Other Embodiments

The present disclosure is not limited to the above embodiments and includes other embodiment described below.

Furthermore, the present disclosure includes combinations of all or a part of the above embodiments. In addition, various omissions, replacements, and modifications may be made to the these embodiments without departing from the scope of invention, and the modifications may be included in the present disclosure.

Figure 15:
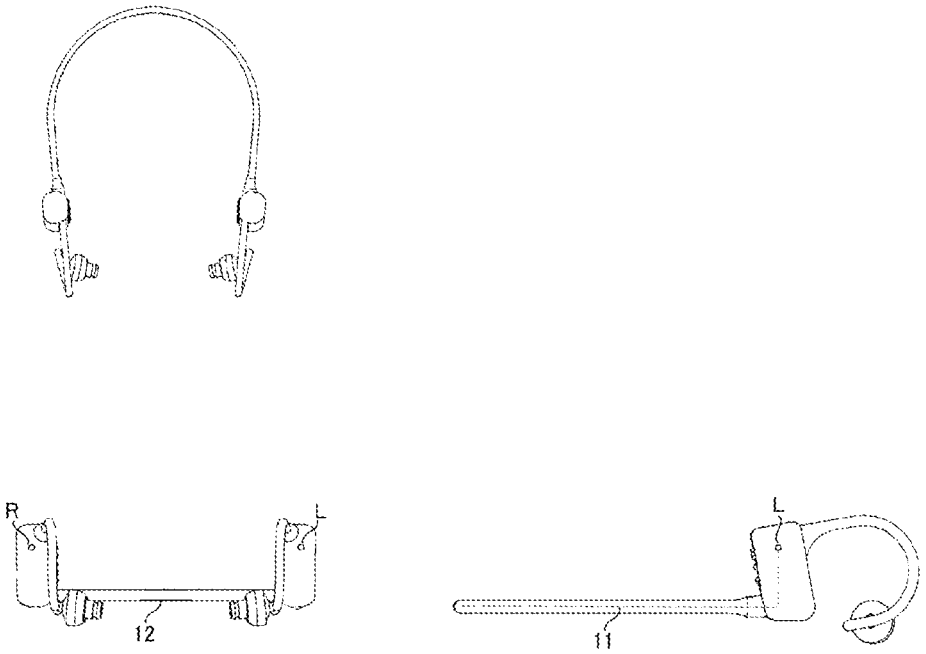
FIG. 15 is an external view of a hearing assistance device according to another embodiment.

For example, although the hearing assistance device 1 is a glasses-type, types of the device is not limited as long as the user can wear the device. FIG. 15 is an external view of a hearing assistance device 1 according to another embodiment. The hearing assistance device 1 in FIG. 15 is a band-type.

In a case of the band-type hearing assistance device 1, the microphones L and R, the speakers 51 and 52, and the signal processing circuit 6 is arranged in the right and left housings 41 and 42. The right and left housings 41 and 42 are supported by a band portion 12 hanged around a neck. The code 11 is embedded inside the band portion, and the pair of housings 41 and 42 is connected by the code 11.

The band-type hearing assistance device 1 can also subtract the signal InA(k) from the signal INC(k) to subtract the voice produced by the user from the signal which is the uniformly collected sound around the user or from the signal which is emphasized voice in the gazing direction of the user.

REFERENCE SIGN

1: hearing assistance device
2: rim
31, 32: temple
41, 42: housing
51, 52: speaker
6: signal processing circuit
7: microphone controller
8: sound emission controller
9: sound processor
91: switching controller
92: target sound processor
93: mouth directivity sound processor
94: comparative sound processor
95: voice detector
96: noise canceller
10: pressure sensor
11: code
12: band portion

The invention claimed is:

1. A hearing assistance device worn by user, comprising:
a pair of microphones which is separated and positioned on both sides of a head of the user;
a pair of speakers which is separated and positioned on both ears of the user or positioned near the ears and which emits sound;
a first sound processor which relatively emphasizes voice produced from a sound source positioned at a mouth of the user based on an input signal from each of the microphones; and
a noise canceller which subtracts a signal processed by the first sound processor from the input signal from the microphones,
wherein:
one of the pair of microphones are two omnidirectional microphones,
the hearing assistance device further comprises a second sound processor which relatively emphasizes a voice from a sound source in a gazing direction of the user, and
the noise canceller subtracts the signal processed by the first sound processor from the signal processed by the second sound processor.

2. The hearing assistance device according to claim 1, further comprising a voice detector which detects a voice produced by the user based on the input signal from each of the microphones,
wherein the noise canceller subtracts the signal processed by the first sound processor from the input signal from the microphones when the voice is produced by the user.

3. The hearing assistance device according to claim 1, wherein the two omnidirectional microphones are arranged on a line in parallel with the gazing direction of the user.

4. The hearing assistance device according to claim 1, further comprising a second sound processor which relatively emphasizes a voice from a sound source in a gazing direction of the user,
wherein the noise canceller subtracts the signal processed by the first sound processor from the signal processed by the second sound processor.

5. The hearing assistance device according to claim 1, further comprising a switching controller to output the signal from the noise canceller to the speaker based on a switching signal.

6. The hearing assistance device according to claim 5, further comprising:
a blur detector which detects a blur of the two microphones arranged near one of the speakers; and
a switching signal outputter which outputs the switching signal when the blur detector detects the blur for a certain time or more.

7. The hearing assistance device according to claim 5, further comprising:
a switch which receives an input from the user; and
a switching signal outputter which outputs the switching signal by ON/OFF of the switch.

8. The hearing assistance device according to claim 1, further comprising:
a rim which fixes lenses; and
temples which support the rim from both sides,
wherein the pair of microphones are separated and arranged in the temples, respectively.

9. The hearing assistance device according to claim 1, further comprising a band portion which is hanged around a neck of the user,
wherein the pair of microphones and the pair of speakers are separated and arranged on both ends of the band respectively.

* * * * *